United States Patent [19]

Nickels, Jr. et al.

[11] Patent Number: 4,800,357

[45] Date of Patent: Jan. 24, 1989

[54] TRANSFORMER SUPPORT ASSEMBLY

[75] Inventors: Richard C. Nickels, Jr., Hampstead; Gary S. Podhorniak, Baltimore, both of Md.

[73] Assignee: Black & Decker, Inc., Newark, Del.

[21] Appl. No.: 164,828

[22] Filed: Mar. 4, 1988

[51] Int. Cl.[4] ..... H01F 27/26; H01F 27/30

[52] U.S. Cl. ..... 336/198; 336/210

[58] Field of Search ..... 336/198, 208, 210, 192, 336/185, 184; 310/194

[56] References Cited

U.S. PATENT DOCUMENTS

| | | | |
|---|---|---|---|
| 3,243,746 | 3/1966 | Doggart et al. | 336/198 X |
| 4,311,978 | 1/1982 | Crockett et al. | 336/192 X |
| 4,318,067 | 3/1982 | Weiner | 336/198 X |

FOREIGN PATENT DOCUMENTS

| | | |
|---|---|---|
| 0017161 | 10/1980 | European Pat. Off. . |
| 0245083 | 11/1987 | European Pat. Off. . |
| 478876 | 10/1927 | Fed. Rep. of Germany . |
| 512250 | 10/1930 | Fed. Rep. of Germany . |
| 2223005 | 5/1973 | Fed. Rep. of Germany . |
| 7301124 | 3/1974 | Fed. Rep. of Germany . |
| 7342490 | 5/1974 | Fed. Rep. of Germany . |
| 7206693 | 7/1975 | Fed. Rep. of Germany . |
| 7417097 | 10/1975 | Fed. Rep. of Germany . |
| 7535975 | 3/1976 | Fed. Rep. of Germany . |
| 2500293 | 8/1976 | Fed. Rep. of Germany . |
| 2541814 | 3/1977 | Fed. Rep. of Germany . |
| 2233005 | 12/1977 | Fed. Rep. of Germany . |
| 7734497 | 3/1978 | Fed. Rep. of Germany . |
| 3043773 | 6/1981 | Fed. Rep. of Germany . |
| 3032005 | 4/1982 | Fed. Rep. of Germany . |
| WO85/05730 | 12/1985 | PCT Int'l Appl. . |
| 1339151 | 11/1973 | United Kingdom . |
| 2146847 | 4/1985 | United Kingdom . |

*Primary Examiner*—Thomas J. Kozma

*Attorney, Agent, or Firm*—Finnegan, Henderson, Farabow, Garrett & Dunner

[57] ABSTRACT

A transformer support assembly for holding primary and secondary coils and a pair of U-shaped cores in operative relation, the assembly comprising first and second integrally-formed, one-piece bobbins, each bobbin including a post axially extending between opposed flanges spaced for windingly receiving one of the coils around the post, each bobbin having an axial bore through the post and flanges for receiving one leg of each held core in opposed relation, and an integrally-formed, one-piece separator including C-shaped channels for engaging corresponding flanges of both the bobbins to position the posts in generally parallel, spaced relation and opposed pairs of jaws adapted to grip base portions of held cores for biasing the legs thereof toward one another in axially opposed relation in said bores.

9 Claims, 2 Drawing Sheets

TRANSFORMER SUPPORT ASSEMBLY

BACKGROUND OF THE INVENTION

1. Field of the Invention

The present invention relates to a transformer and more particularly to a support assembly for holding transformer components in precise operative relation.

2. Description of Related Art

In designing a transformer several factors must be considered. First, to obtain desired electrical and magnetic performance characteristics, a transformer must have precise and stable predetermined spacial relationships between the coils and cores of the transformer. While these relationships will vary among transformers depending on the characteristics desired, the transformer support assembly must hold the components in the desired relationship to ensure constant performance characteristics during use.

While precise and stable relationships between transformer components may be ensured by use of complex and rigid supporting structure, such a structure will increase the costs of material and manufacture. Thus, for economical manufacture of transformers, the support assembly must be designed to minimize material costs, to provide for simple assembly-line production and to allow for certain manufacturing tolerances while ensuring precise and stable relation between components during operation.

Another factor in designing transformers concerns the distance between conductors of opposite polarity. There must be a minimum separation between the primary and secondary coils to ensure proper operation of the transformer. This separation, commonly defined in terms of creepage and clearance distances, will depend on whether the coils are potted in a compound. In compound-filled coils, the potting compound significantly increases the cost of the transformer and may also limit heat dissipation.

To avoid the disadvantages of compound-filled transformer coils, unpotted transformers have been used. These transformers require larger creep paths and clearance for insulation between coils and between coils and associated magnetic cores. Where small transformers are designed, creepage and clearance becomes critical.

The transformer disclosed in British Pat. No. 1,339,151 to Hinchley Engineering Co. is taught to provide sufficient creepage and clearance between the components. Primary and secondary coils are wound on bobbins which are mated to opposite sides of a separator and the legs of opposed U-shaped cores are disposed in bores in the bobbins. Since the coils are potted, the structure of the transformer does not provide creepage and clearance distances required for air cooled transformers. Additionally, the structure does not provide means for securing the cores in precise, stable relationship to each other and to the coils.

A ferrite choke coil is taught in British Specification No. 146,847 filed by American Telephone & Telegraph Co. This device incorporates a single E-shaped core the center leg of which is disposed in the post of support assembly around which are wound primary and secondary coils axially separated by a wall. The core is rigidly held in position by locking tabs on jaws engaging its base; such a rigid structure does not allow for certain manufacturing tolerances thereby increasing material costs. The extremely close relationship between the coils and between the coils and the core legs suggests a lack of concern for creepage and clearance which must be considered in small, air-cooled transformers.

The present invention overcomes the disadvantages of prior art transformer support assemblies by providing a support structure which is easily assembled, which ensures precise and stable component relationships with adequate creepage and clearance for use of air- cooled coils, and which allows for certain tolerance build-up in the components.

SUMMARY OF THE INVENTION

The advantages of the invention may be realized and obtained by means of the instrumentalities and combinations particularly pointed out in the appended claims.

In accordance with the invention, as embodied and broadly described herein, a transformer support assembly for holding primary and secondary coils and a pair of U-shaped cores in operative relation comprises first and second bobbins, each bobbin including a post axially extending between opposed flanges spaced for windingly receiving one of the coils around the post, each bobbin having an axial bore through the post and flanges for receiving one leg of each held core in axially opposed relation, and a separator including means engaging corresponding flanges of both bobbins for positioning the posts in generally parallel, spaced relation and means adapted to grip base portions of held cores for biasing the legs thereof toward one another in axially opposed relation in the bores.

In a preferred embodiment, the bobbins and separator are each integrally-formed in one piece.

Preferably, the separator comprises a wall axially extending between opposed plates forming a generally I-shaped transverse cross section, each plate having opposed sides transversely extending from the wall a predetermined distance and opposed ends, and the positioning means preferably includes projections depending from the opposed ends of each plate toward one another and defining elongated, transversely-extending C-shaped channels open toward the wall for receiving and frictionally engaging the flanges of each bobbin on opposite sides of the wall.

It is preferred that the biasing means comprise a pair of opposed jaws axially extending from each plate of the separator, each pair of opposed jaws forming a transversely-extending slot for receiving the base of a respective one of a pair of held cores, each jaw of each opposed pair of jaws having a remote end and one jaw of each pair of opposed jaws including at the remote end thereof a rib projecting toward the corresponding opposed jaw for engaging the base of a held core to prevent axial movement thereof out of the slot, at least one pair of opposed jaws being disposed to impose on a held core an axial biasing force in opposition to another held core received in the other pair of opposed jaws.

In a preferred embodiment the one jaw of each pair of opposed jaws is formed of a resilient material and is convergingly inclined toward the corresponding opposed jaw to space the remote ends thereof a distance selected to ensure engagement of a held core by the rib and wherein the rib on the one jaw of at least one pair of opposed jaws includes an inclined inner surface disposed to impose the axial biasing force upon the base of a held core.

BRIEF DESCRIPTION OF THE DRAWINGS

The accompanying drawings, which are incorporated in and constitute a part of the specification, illustrate one embodiment of the invention, and together with the description, serve to explain the principles of the invention.

FIG. 13 is an enlarged view of the terminal socket within circle XIII of FIG. 12.

DETAILED DESCRIPTION OF THE PREFERRED EMBODIMENTS

Reference will now be made to the present preferred embodiment of the invention, an example of which is illustrated in the accompanying drawings.

The transformer support assembly of the invention comprises first and second bobbins, each bobbin including a post axially extending between opposed flanges spaced for windingly receiving one of primary and secondary coils around the post, each bobbin having an axial bore through the post and flanges for receiving in axially opposed relation one leg of each of a pair of held U-shaped cores.

Figure 1:
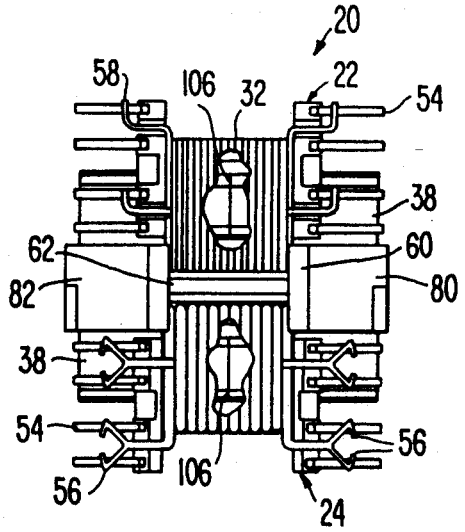
FIG. 1 is a plan view of an embodiment of the invention assembled with coils and cores in place.
Figure 2:
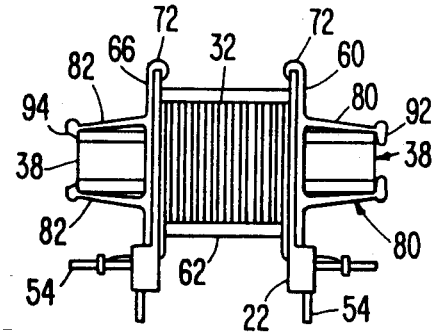
FIG. 2 is an end view of the embodiment of FIG. 1.
Figure 3:
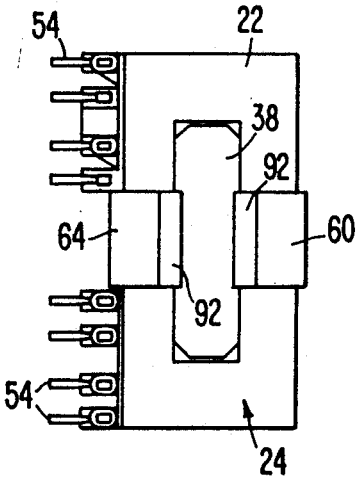
FIG. 3 is a side view of the embodiment of FIG. 1.

As depicted in FIGS. 1 and 3, support assembly 20 comprises first and second bobbins 22, 24. As best seen in FIGS. 6, 7, 9 and 10, each bobbin preferably includes a post 26 axially extending between opposed flanges 28, 30 spaced for windingly receiving one of primary and secondary coils 32, 34, respectively, around post 26. Each bobbin has an axial bore 36 extending through post 26 and flanges 28, 30.

Figure 4:
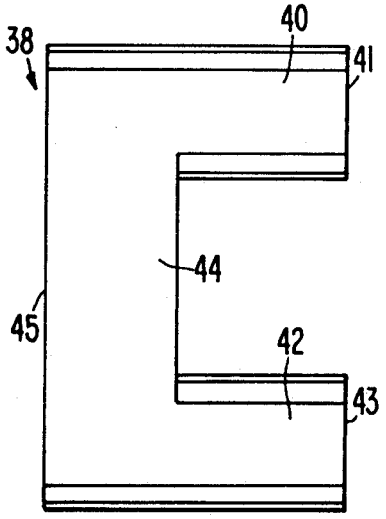
FIG. 4 is a side view of a core disposed in the embodiment of FIG. 1.
Figure 5:
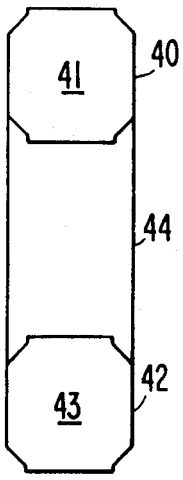
FIG. 5 is an end view of the core of FIG. 4.
Figure 6:
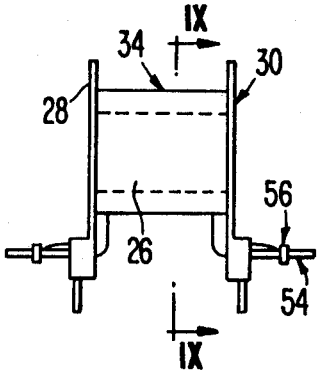
FIG. 6 is an end view of one bobbin of the embodiment of FIG. 1.
Figure 7:
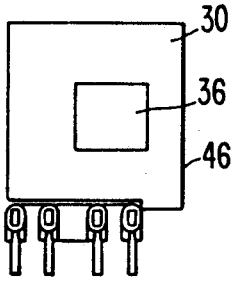
FIG. 7 is a side view of the bobbin of FIG. 6.

Bores 36 in bobbins 22, 24 are open at both ends for receiving in axially opposed relation one leg of each U-shaped core 38. While cores 38 may be of any appropriate cross-sectional shape, preferably each core 38 has legs 40, 42 and base 44 with a generally square cross section as depicted in FIGS. 4 and 5. Preferably, outer surface 45 of base 44 is planar and generally perpendicular to the axes of legs 40, 42. Legs 40, 42 have remote ends 41, 43. Bores 36 in the bobbins have a cross-sectional size and shape corresponding to the cross-sectional shape of the legs of the cores. Dimensionally, bores 36 preferably provide a close fit for legs 40, 42 of cores 38.

Bobbins 22, 24 are preferably integrally-formed in one piece from plastic material such as glass-reinforced nylon sold by Allied Signal, Inc. under the name Allied 8233. The plastic used should be slightly resilient.

Figure 14:
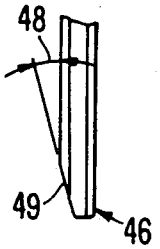
FIG. 14 is an enlarged view of the flange edge within circle XIV of FIG. 10.

Preferably, each flange 28, 30 on bobbins 22, 24 includes a linear edge 46 transversely spaced from post 26 a predetermined distance. As discussed below, the predetermined distance contributes to the creepage and clearance between coils. The linear edge of the two flanges on a bobbin are spaced the same distance from and in the same direction from the post of the bobbin. Each linear edge is tapered as seen particularly in FIG. 14 to facilitate assembly of the transformer as discussed below. The angle 48 of the taper 49 is preferably 15 degrees from the plane of the flange. In the preferred embodiment, each flange is rectangular, generally planar and generally parallel to the other flange. Linear edge 46 is the edge of one side of the rectangular flanges.

Figure 8:
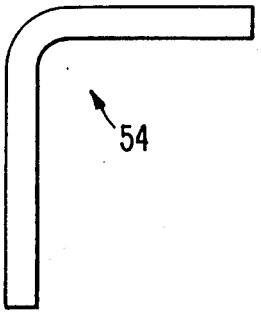
FIG. 8 is a side view of one terminal of the embodiment of FIG. 1.
Figure 9:
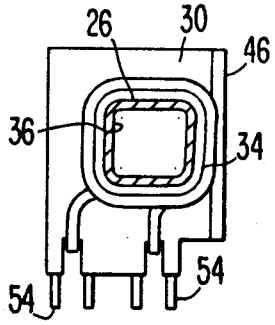
FIG. 9 is a cross-sectional view of the bobbin of FIG. 6 taken along IX—IX.
Figure 10:
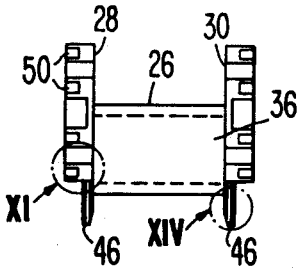
FIG. 10 is a plan view of a bobbin of the embodiment of FIG. 1 with coil and terminals removed.
Figure 11:
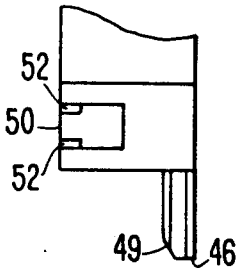
FIG. 11 an enlarged view of the terminal socket within circle XI in FIG. 10.
Figure 12:
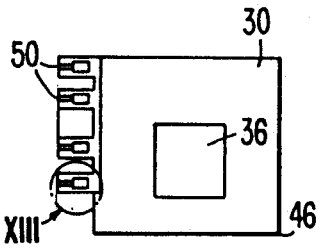
Figure 13:
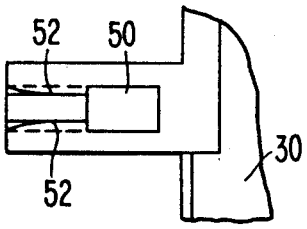
FIG. 13 is a side view of the bobbin of FIG. 10.

Each bobbin may include at least one flange having means integrally-formed thereon for holding electrical connectors or terminals. In the preferred embodiment, each flange 28, 30 of each bobbin 22, 24 includes a plurality of terminal sockets 50 formed on an edge of the flanges in spaced relation to linear edge 46. As depicted in FIGS. 11 and 13, sockets 50 include inwardly projecting opposed ribs 52 for frictionally engaging terminals 54 which may be L-shaped metal conductors as depicted in FIG. 8. The ends 56 of inner and outer winding layers of secondary coil 34 are secured to terminals 54 disposed in sockets 50 on bobbin 24. The start and finish leads 58 of primary winding 32 are secured to terminals 54 disposed in sockets 50 on bobbin 22.

In accordance with the invention, the transformer support assembly comprises a separator including means engaging corresponding flanges of both bobbins for positioning the posts in generally parallel, spaced relation and means adapted to grip base portions of held cores for biasing the legs thereof toward one another in opposed relation in the bores.

Figure 15:
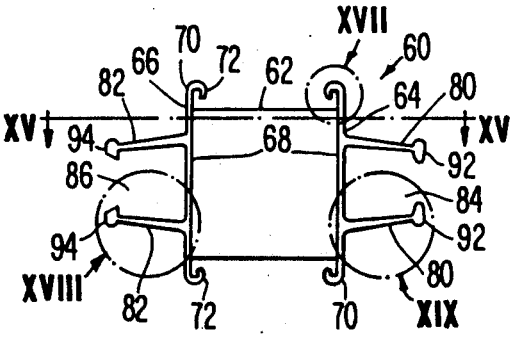
FIG. 15 is an end view of the separator of the embodiment of FIG. 1.
Figure 16:
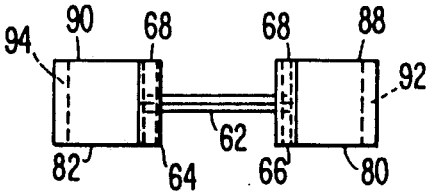
FIG. 16 is a plan view of the separator of FIG. 15.

As embodied herein, separator 60, depicted in FIGS. 15 and 16, comprises wall 62 axially extending between opposed plates 64, 66 forming a generally I- shaped transverse cross section taken along line XV—XV in FIG. 15. Preferably each plate 64, 66 is generally rectangular, generally planar and generally parallel to the other plate and perpendicular to wall 62. Each plate 64, 66 has opposed sides 68 transversely extending from wall 62 a predetermined distance and has opposed ends 70. Separator 60 is preferably integrally-formed in one piece of the same plastic material as bobbins 22, 24.

Figure 17:
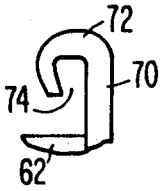
FIG. 17 is an enlarged view of the depending projection within circle XVII of FIG. 15.

Projections 72 on each opposed end 70 of each plate 64, 66 depend toward one another to define elongated, transversely extending, C-shaped channels 74 open toward wall 62 (FIG. 17). Channels 74 receive and frictionally engage flanges of each bobbin 22, 24 on opposite sides of wall 62 for positioning posts 26 in generally parallel, spaced relation. Corresponding tapered linear edges 46 (FIGS. 11, 14) on each bobbin 22, 24 facilitate placement of the flanges into channels 74 such that corresponding flanges 28, 30 of bobbins 22, 24 are generally coplanar on opposite sides of wall 62. The opening of channels 74 have a dimension less than the thickness of flanges 28, 30 in order to frictionally engage the flanges.

Creepage and clearance between coils 32, 34 are determined by the predetermined distance sides 68 of plates 64, 66 transversely extend from wall 62 and by the predetermined distance linear edges 46 on flanges 28, 30 transversely extend from respective posts 26. Preferably the latter predetermined distance is at least equal to the former such that, when flanges 28, 30 are inserted into channels 74, linear edge 46 abuts wall 62 before sides 68 obstruct openings to bores 36. Thus, the predetermined distance linear edge 46 transversely extends from post 26 defines creepage and clearance between coils 32, 34.

Figure 18:
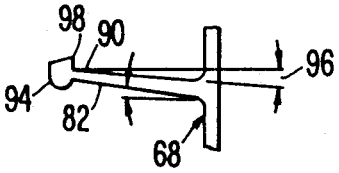
FIG. 18 is an enlarged view of the jaw within circle XVIII or FIG. 15.

In the preferred embodiment, the biasing means comprises a pair of opposed jaws 80, 82 (FIGS. 2, 15, 16, 18 and 19) extending from plates 64, 66, respectively. Each pair of jaws 80, 82 forms a transversely-extending slot 84, 86, respectively, for receiving base 44 of a respective one of cores 38. Each jaw 80, 82 of each pair has a remote end 88, 90, respectively (FIGS. 18, 19) At least one jaw of each pair of opposed jaws includes at remote end 88, 90 a rib 92, 94 projecting toward the corresponding opposed jaw for engaging base 44 of a held core 38 to prevent axial movement thereof. While the preferred embodiment has ribs 92, 94 at remote ends 88, 90 of both jaws 80, 82 of each pair, the invention contemplates use of only one rib with each pair of jaws.

At least one pair of opposed jaws 80, 82 is disposed to impose on a held core an axial biasing force in opposition to another held core received in the other pair of opposed jaws. As embodied herein, each jaw 80, 82 of each pair of opposed jaws is convergingly inclined toward the corresponding opposed jaw, preferably at an angle 96 to the axis of about 5 degrees. Since the material from which the separator 60 is integrally formed has a certain degree of resilience, the inclination of jaws 80, 82 biases ribs 92, 94 into engagement with a held core 38 while allowing the jaws to be deflected outwardly during insertion of a held core into the defined slot 84, 86.

In the particular embodiment depicted in the drawings, each pair of opposed jaws is disposed differently to perform different functions. Jaws 82 are so spaced that the transverse distance between remote ends 90 is equal to or slightly larger than the transverse width of base 44 of held core 38. Ribs 94 on jaws 82 include an inside surface 98 (FIG. 18) forming a shoulder perpendicular to the axis. Surface 98 of each rib 94 extends toward the opposed rib a distance sufficient to engage the outer surface 45 of base 44 of held core 38 to prevent core 38 from axially moving out of transverse slot 86. Because of manufacturing tolerances, it is desirable to have the transverse spacing between remote ends 90 of jaws 82 to be slightly larger than the transverse width of base 44 of held core 38. Such a spacing will ensure that surfaces 98 of ribs 94 are coplanar with outer surface 45 of base 44 of core 38 when in engagement even if the transverse width of base 44 is at the upper end of the tolerance range.

Figure 19:
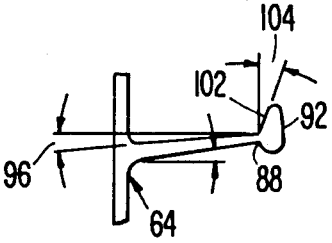
FIG. 19 is an enlarged view of the jaw within circle XIX of FIG. 15.

Jaws 80 are disposed to impose an axial biasing force on held core 38. To achieve this, remote ends 88 of jaws 80 are spaced a transverse distance less than the transverse width of base 44 of held core 38. Ribs 92 on jaws 80 include an inside surface 102 (FIG. 19) which is inclined with respect to the axis. As seen in FIG. 19, surface 102 is inclined at angle 104 to a plane parallel to plate 64. Angle 104 is preferably about 20 degrees. The shoulder defined by angled surface 102 on each rib 92 is disposed to engage planar surface 45 of base 44 of held core 38. Since remote ends 88 of jaws 80 are transversely spaced a distance less than the transverse width of base 44, the resilience of jaws 80 generates a force which angled surface 102 translates into an axial force biasing held core 38 toward plate 64.

When assembling a transformer using the support assembly of the invention, primary and secondary coils 32, 34 are wound on respective bobbins 22, 24. The tapered linear edge 46 of each flange 28, 30 on each bobbin 22, 24 is inserted in respective channels 74 to position the bobbins on opposite sides of wall 62 of separator 60 with corresponding flanges 28, 30 generally coplanar and with posts 26 in parallel, spaced relation. One core 38 is disposed in transverse slot 86 with one of legs 40, 42 axially disposed in bore 36 of a respective one of bobbins 22, 24. The outside surface 45 of base 44 is engaged by surfaces 98 on ribs 94 preventing axial movement of core 38 away from plate 66.

The other core 38 is disposed in transverse slot 84 with one of legs 40, 42 axially disposed in bore 36 of a respective one of bobbins 22, 24 such that the corresponding legs 40, 42 of cores 38 are in axial opposition in bores 36. For proper electrical and magnetic operation of the transformer, a mechanical spacer 106 (FIG. 1) is disposed between the opposed end surfaces 41, 43 of corresponding legs 40, 42 of cores 38. In the preferred embodiment, mechanical spacers 106 are pieces of tape having adhesive on both sides. Outer surface 45 of base 44 of the other core 38 is engaged by inclined surfaces 102 which, as discussed above, impose an axial force on core 38. Because core 38 in slot 86 is axially restricted, the axial biasing force on core 38 in slot 84 tends to bias opposed end surfaces 41, 43 together thereby compensating for variations in the dimensions of cores 38.

The axial distance between remote ends 88, 90 of jaws 80, 82, respectively, is selected to be substantially equal to the axial distance between outer surfaces 45 of cores 38 when axially opposed end surfaces 41, 43 are axially spaced the desired, predetermined amount.

The transformer support assembly of the invention provides a simplified structure for holding the coils and U-shaped cores in precise, fixed operative relationship. The assembly simplifies manufacture of transformers and allows for tolerance build up in the operative components without affecting the spacial relationship required for optimum electrical and magnetic characteristics. The interrelationship of the components of the assembly defines precise creepage and clearance between electrical components of opposite polarity and prevents inadvertent variation of such during manufacture.

It will be apparent to those skilled in the art that various modifications and variations could be made in the assembly of the invention without departing from the scope and spirit of the invention.

What is claimed is:

1. A transformer support assembly for holding primary and secondary coils and a pair of U-shaped cores in operative relation, said assembly comprising:

first and second bobbins, each bobbin including a post axially extending between opposed flanges spaced for windingly receiving one of said coils around said post, each bobbin having an axial bore through said post and said flanges for receiving one leg of each held core in axially opposed relation; and a separator including means engaging corresponding flanges of both said bobbins for positioning said posts in generally parallel, spaced relation and means adapted to grip base portions of held cores for biasing the legs thereof toward one another in axially opposed relation in said bores.

2. The assembly of claim 1 wherein said separator comprises a wall axially extending between opposed plates forming a generally I-shaped transverse cross section, each plate having opposed sides transversely extending from said wall a predetermined distance and opposed ends, and wherein said positioning means includes projections depending toward one another from the opposed ends of each plate and defining elongated, transversely-extending C-shaped channels open toward said wall for receiving and frictionally engaging the flanges of each said bobbin on opposite sides of said wall.

3. The assembly of claim 2 wherein each flange of each said bobbin includes a linear edge transversely spaced from said post, each said edge being tapered for facilitating slidable placement in said C-shaped channels.

4. The assembly of claim 3 wherein the linear edge of each flange is transversely spaced from said post a distance at least equal to said predetermined distance.

5. The assembly of claim 2 wherein said biasing means comprises a pair of opposed jaws axially extending from each plate of said separator, each pair of opposed jaws forming a transversely-extending slot for receiving the base of a respective one of a pair of held cores, each jaw of each said opposed pair of jaws having a remote end and one jaw of each pair of opposed jaws including at the remote end thereof a rib projecting toward the corresponding opposed jaw for engaging the base of a held core to prevent axial movement thereof out of said slot, at least one said pair of opposed jaws being disposed to impose on a held core an axial biasing force in opposition to another held core received in said other pair of opposed jaws.

6. The assembly of claim 5 wherein the one jaw of each pair of opposed jaws is formed of a resilient material and is convergingly inclined toward the corresponding opposed jaw to space the remote ends thereof a distance selected to ensure engagement of a held core by said rib and wherein the rib on the one jaw of said at least one said pair of opposed jaws includes an inclined inner surface disposed to impose said axial biasing force upon the base of a held core.

7. The assembly of claim 1 wherein at least one flange of each said bobbin includes means integrally-formed thereon for holding electrical connectors.

8. A transformer comprising:

first and second bobbins each including a post axially extending between rectangular flanges perpendicular to and having peripheral edges spaced from the axis of said post, each bobbin having an axial bore extending through the post and flanges;

primary and secondary coils wound around the posts of said first and second bobbins, respectively;

a separator including a wall axially extending between rectangular plates perpendicular to said wall, projections depending toward one another from the opposed ends of each said plate and defining transversely-extending C-shaped channels open toward said wall, and a pair of opposed jaws axially extending from each said plate to remote ends and defining a transversely-extending slot, the jaws of each said pair being formed of resilient material, being inclined toward each other to define a predetermined spacing between the remote ends thereof and including an inwardly projecting rib on each remote end, the ribs on the jaws of one said pair having inclined inner surfaces, the peripheral edge of each flange being disposed and frictionally engaged in a respective channel to place said bobbins in opposed, spaced relation on opposite sides of said wall; and a pair of U-shaped cores disposed in axially opposed relation with one leg of each core being axially opposed in each said bore, the base of each said core being disposed in the slot defined by a respective one of said pair of opposed jaws and being engaged by said ribs to prevent axial movement of said base out of said slot, the inclined surfaces on the ribs of said one pair of opposed jaws biasing the respective core axially toward the core disposed between the jaws of the other said pair of opposed jaws.

9. The transformer of claim 8 also including a spacer disposed between the ends of the opposed legs of said cores.

* * * * *